United States Patent [19]

Müller et al.

[11] 4,199,117

[45] Apr. 22, 1980

[54] WINDING DEVICE FOR METAL STRIPS

[75] Inventors: Friedrich Müller; Gerhard Kummerhoff; Ewald Uphues, all of Hemer, Fed. Rep. of Germany

[73] Assignee: Sundwiger Eisenhutte Maschinenfabrik Grah & Co., Hemer-Sundwig, Fed. Rep. of Germany

[21] Appl. No.: 974,060

[22] Filed: Dec. 28, 1978

[30] Foreign Application Priority Data

Dec. 31, 1977 [DE] Fed. Rep. of Germany ..... 2759224

[51] Int. Cl.[2] ..... B65H 23/14

[52] U.S. Cl. ..... 242/75.2; 226/195; 242/78.1

[58] Field of Search ..... 242/75.2, 78.1, 80, 242/76, 56.2–56.7; 226/39, 195, 181–187

[56] References Cited

U.S. PATENT DOCUMENTS

| | | | |
|---|---|---|---|
| 2,033,625 | 3/1936 | French | 226/195 |
| 3,294,331 | 12/1966 | Wang et al. | 242/75.2 X |
| 3,368,771 | 2/1968 | Schmidt et al. | 242/75.2 |
| 3,386,679 | 6/1968 | Foulon et al. | 242/75.2 X |

*Primary Examiner*—John M. Jillions

*Attorney, Agent, or Firm*—J. Harold Nissen

[57] ABSTRACT

Winding device for metal strips, in which the metal strip is braked between two rollers which are pressed against one another. One of the rollers has a larger angle of wrap for the metal strip of at least 75° and the other roller has a smaller angle of wrap for the metal strip of 45° at maximum. The one roller with the larger wrap includes material on its periphery having a coefficient of friction for the material which is at least 20% lower relative to the braked metal strip than the coefficient of friction of the peripheral material of the other roller with the smaller amount of wrap.

18 Claims, 6 Drawing Figures

WINDING DEVICE FOR METAL STRIPS

BACKGROUND OF THE INVENTION

The invention relates to a winding device for metal strips.

More particularly, the invention is concerned with the braking of a metal strip which is divided longitudinally into a plurality of tapes.

DESCRIPTION OF THE PRIOR ART

The winding devices for metal strips are composed of a recoiler and a pull or brake roller system. Other braking systems, e.g. presses or an eddy current field can be provided in place of rollers. Problems arise with the winding devices because as even and as uniform a pull-back as possible should be produced on the one hand. However, due to slippage on the other hand, the pull-back can have detrimental side-effects such as scratching on the strip surface, increased abrasion of the surface of the rollers and difficulties in moving the strip. A typical method of constructing the pull and brake system is to use so-called S rollers, whereby the metal strip surrounds each of the two spaced rollers at a large angle of wrap. In conjunction with such an S roller aggregate, it is known to insert an additional roller which is intensively screwed down at the first roller at the level of the point where the metal strip runs in. (See "Herstellung von kaltgewalztem Band", part 1, Verlag Stahl Eisen, Düsseldorf 1970, page 98, picture 25). Considerable problems arise in this construction due to slippage. It is an object of the present invention to avoid surface damage caused by slippage and to develop a construction which guarantees or assures as even a pull-back as possible.

In particular, the aforementioned problems arise when the winding device is used for braking a metal strip which is divided longitudinally into a plurality of tapes. Different winding diameters arise on the recoiler when winding such tapes due to differences in thickness. For example, these different diameters cause differences in winding speeds. In order to achieve a firm winding with all tapes, the braking device provided must permit a difference in speed of from 1 to 2% with the tapes and still impart to all tapes as even a pull-back as possible. In spite of a large number of proposed solutions, this problem is still unsolved. Various proposals for solution are discussed below; however, these proposals have not been able to solve the problem completely.

Reference is made to the journal "Bänder, Bleche, Rohre" (1–1975), pages 12–16 in particular page 14, pictures 5 and 7, which describes winding devices which are used for braking metal tapes. In the known construction according to picture 5, the tapes are drawn between two braked rollers. The tapes pass practically tangentially between the two rollers and are braked by the braked rollers. An advantage of this known construction is the low risk of surface damage. The disadvantage of this construction is that the strips run laterally between the rollers by line pressure. In the construction according to picture 7 only one of the rollers is braked while the other pressed roller runs freely. This construction permits a slightly greater balance of different winding diamters and the different speeds of the tapes resulting therfrom. However, the problems of the tapes running laterally, particularly with board and thin tapes, still remain. In order to overcome the problem of the laterally running tapes, it is proposed in this publication (see picture 6) to provide a strip press in combination with the rollers pressed one against the other. This strip press, which is arranged in front of the rollers, involves the risk of damage on the surface of the braked tapes. The aforementioned journal also shows a construction in picture 11 on page 15 in which the tapes are braked by means of an S roller block. In an S roller block, the two rollers are known to be spaced from one another, i.e. they are not pressed against one another with their periphery. The tapes run over each of the rollers of the S roller block at a large angle of wrap. An entry pull in the tapes to be braked is necessary in arrangements of this type. The entry pull, for example, is applied by means of a strip press. Similarly, there is the danger of damage to the surface on the braked tapes. Also shown in the journal in picture 14 on page 15 is an embodiment in which the initial pull is applied by eddy currents. Besides the costly construction, the braking forces generated in this way are only sufficient in special cases.

It is also known to provide a plastic fibrous web which have a coefficient of friction $\mu$ of 0.25 to 0.33 relative to the dry metal strip.

It is an object of the invention to develop a winding device which guarantees as even a even a brake pull as possible without causing surface damage.

In particular, in the use of the device for braking longitudinally divided metal tapes, it is to be additionally indicated or guaranteed that the tapes do not run laterally. A firm and reliable winding of the tapes is to be indicated or guaranteed without surface damage being caused.

According to the invention, the object is accomplished by providing a material with a coefficient of friction $\mu_\alpha$ on the periphery of the roller with the larger wrap which is at least 20% lower relative to the braked metal strip than the coefficient of friction $\mu_\beta$ of the peripheral material of the roller with the smaller amount of wrap. The coefficient of friction is preferably at least 50% lower, and in particular more than 70% lower. The angle of wrap $\alpha$ of the roller with the larger wrap preferably amounts to at least 90° and the angle of wrap of the roller with the smaller amount of wrap is preferably below 30°, and in particular below 15°.

The differences in the coefficient of friction $\mu$ of the peripheral material result, for example, with a dry metal strip when the peripheral material of the roller with the small amount of wrap is composed of polyurethane (coefficient of friction $\mu$ relative to dry metal is 0.5) and the periphery of the roller with the larger wrap is formed from a plastic fibrous web. Plastic fibrous web as noted above which have a coefficient of friction $\mu$ of 0.25 to 0.33 relative to the dry metal strip are part of the prior art.

With respect to the peripheral materials of the rollers, it should be ensured that the coefficients of friction between the peripheral material and the strip material alter when the strip is oiled. This can be seen, for example, from the following Table.

| Roller Surface Material | Coefficient of friction $\mu$ | |
|---|---|---|
| | dry metal strip | oiled metal strip |
| polyurethane | 0.5 | 0.1 to 0.2 |

-continued

| Roller Surface Material | Coefficient of friction $\mu$ dry metal strip | oiled metal strip |
|---|---|---|
| plastic fibrous web | 0.25 to 0.33 | 0.2 to 0.3 |

As can be seen from the above Table, when using the oiled metal strip the coefficient of friction $\mu$ is reduced considerably more with the roller surface material polyurethane than with the roller surface material plastic fibrous web. The roller surface material plastic fibrous web has the higher coefficient of friction $\mu$ with oiled metal strip. In order to take these conditions into account, a preferred embodiment of the invention provides for the feature of the interchangeability of the two rollers. This is preferably achieved by the two rollers being pivoted on a joint rocker and being swingable around a central axis of the rocker. Since the roller with the smaller amount of wrap should have the higher coefficient of friction $\mu_\beta$, then the roller with the smaller amount of wrap is preferably composed of a plastic fibrous web with the oiled metal strip, whereas the roller with the larger wrap should have a surface material of polyurethane.

Thus, when using the winding device for braking a dry metal strip which is divided longitudinally into a plurality of tapes, it is advantageous if the coefficient of friction $\mu_\alpha$ of the roller with the larger wrap relative to the component strips is below 0.35. When using the winding device for braking an oiled metal strip which is divided longitudinally into a plurality of tapes, it is advantageous if the coefficient of friction $\mu_\alpha$ of the roller with the larger wrap relative to the tapes is below 0.22.

Further, it is expedient if the roller with the smaller amount of wrap is braked. The pull-back can be increased by the braking. In order to press the two rollers against each other the rollers are, for expedience, pressed against one another by forces of 0.5 to 5 kp/cm$^2$. This pressing can be achieved with a piston-cylinder device, for example, which for instance works on the axis of the roller with the smaller amount of wrap. The pressing causes a slight flattening at the point where the roller with the smaller amount of wrap touches the metal strip or the tapes, and therefore the preferred low wrapping is also guaranteed when the metal strip runs practically tangentially into the roller with the smaller amount of wrap.

Tangential entry of the metal strip into the roller is particularly desired since this poses the least risk of damage to the surface of the metal strip. On tangential entry, for example, an angle of wrap of less than 8° is observed e.g. 1 to 4° depending on the surface material of the roller with the small amount of wrap. Tangential entry is particularly suited for careful treatment of metal strips with highly sensitive surfaces. It is expedient to press the roller with the smaller amount of wrap onto the roller with the larger amount of wrap at the point where the metal strip runs into the roller with the larger wrap. After the run-in point has been pressed, which in this case corresponds to the clamping point between the two rollers, in tapes are then only run over a large range around the roller with the larger wrap, so that slippage can be balanced out. This balancing of the slippage greatly reduces the danger of surface damage, as the roller with the larger wrap is provided with a much lower coefficient of friction $\mu_\alpha$ relative to the surface of the metal strip. The subject of the invention therefore indicates or guarantees a sufficiently great application of a braking pull through the roller with the smaller amount of wrap, i.e. a favorable braking accompanied by a favorable equalization of the slippage and a careful treatment of the surface of the metal strip.

When using the device according to the invention for braking tapes, it is further of advantage to guarantee that after leaving the point of run-off which point is designated A, from the roller with the larger wrap, then the tapes only run as short a distance as possible to a run-on point, which point is designated in the drawings as R, of the winding coil forming on the recoiler. The free length of the path should be as short as possible.

It has therefore proved expedient to have the two rollers set in their distance from the recoiler in such a manner that length of the tapes is less than half the periphery of the roller with the larger wrap, which point is designated from the point E in the drawings, where the tapes are clamped between the two rollers to the point R where the tapes are taken up by winding coil forming on the recoiler. The short free path length can be guaranteed when the winding coil is increasing if the two rollers and/or the recoiler are arranged so that they can be moved relatively to one another. The short free path length to be achieved with the aforementioned feature guarantees that the tapes run onto the respective winding ring of the recoiler reliably and firmly. The tapes run onto the respective winding ring practically directly after leaving the roller with the larger wrap. Therefore, the free path length is less than 200 mm, for example, and in particular less than 100 mm.

The particular advantages of the subject matter of the invention are to be seen in that a very good guidance of the metal strip is provided. In particular, a good guidance of the tapes also is indicated or guaranteed with careful treatment of the surface of the metal strip. A reliable winding which takes care of the surface is indicated or guaranteed even in the case of a metal strip with, for example, 30 to 60 tapes.

Other objects, advantages and the nature of the invention will become readily apparent from the preferred embodiments described in connection with the accompanying drawings.

DESCRIPTION OF THE PREFERRED EMBODIMENTS

Figure 1:
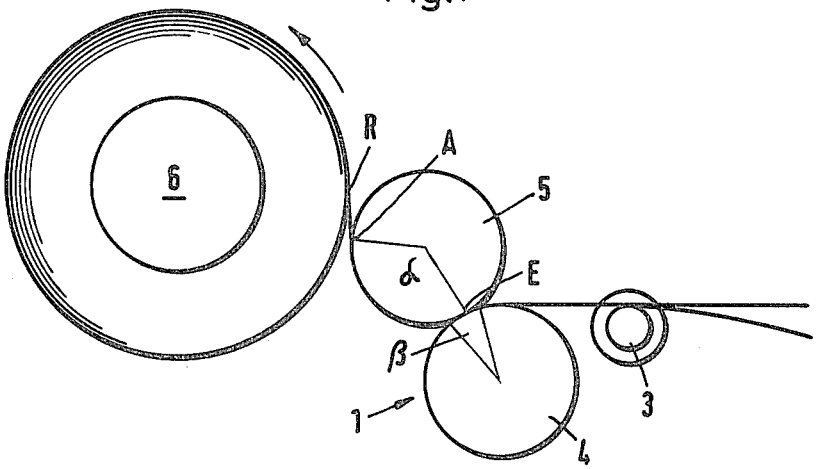
FIG. 1 is a schematic side view of one embodiment of the invention.

In all of the figures of the drawings the same reference numerals designate like parts throughout.

Figure 2:
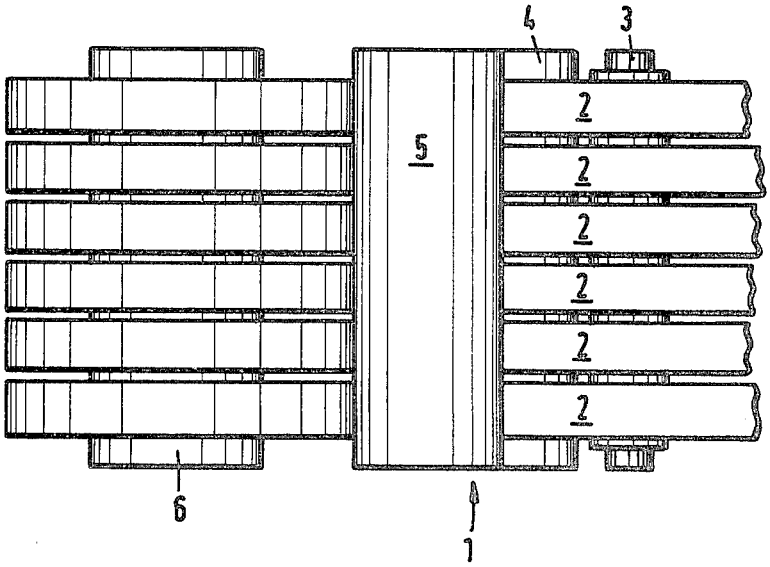
FIG. 2 is a top view of the embodiment of FIG. 1.

Referring now more particularly to FIGS. 1 and 2 of the drawings, winding device 1 is shown in conjunction with a metal strip which is divided into six tapes 2. These tapes 2 first run over a separating roller 3, then through the winding device 1, and subsequently onto respective winding coils forming on a recoiler 6. The winding device 1 has two rollers 4,5 pressed one against the other. The roller 4 which is furtherest away from the recoiler 6 is wound by or wrapped by a small amount or small portion of tapes 2 and the rollers which are nearest to the recoiler 6 has a larger amount of winding or wrap. The angle of wrap $\beta$ of the roller 4 with the smaller amount of wrap amounts to slightly less than 15°, and the angle of wrap $\alpha$ of the roller 5 with the larger wrap amount to about 120°.

The roller 4 with the smaller amount of wrap is pressed by pressing devices (not shown) against the roller 5 with the large amount of wrap. Following the course of the tapes 2, it is first run onto the roller 4 with the small amount of wrap, and then the tapes 2 are run in between the tangency point of the two rollers 4,5 at point E. The position of the run-in point E can be exactly defined by a conceived connection line between the central points of the axis of the two rollers 4 and 5. At the clamping point E, the tapes 2 run tangentially to the periphery of the two rollers 4,5, i.e. vertically to the conceived connection line. Then, the tapes wind round the roller 5 from the clamping point E to run-off point A. The tapes then leave the roller 5 at the run-off point A, and then at the run-on point R the tapes run onto the winding coil forming on the recoiler 6. The distance between the clamping point E of the tapes between the two rollers 4 and 5 to the run-on point R amounts to about four-ninths of the periphery of the roller 5 according to FIG. 1 or an angle of 160°. If it is taken into consideration that an angle of wrap of 120°, which corresponds to three-ninths of the roller 5 of the periphery, is provided for the roller 5, then there remains only a distance of about one-ninth of the periphery of roller 5 for the free path length of the component strips between points A and R.

Figure 3:
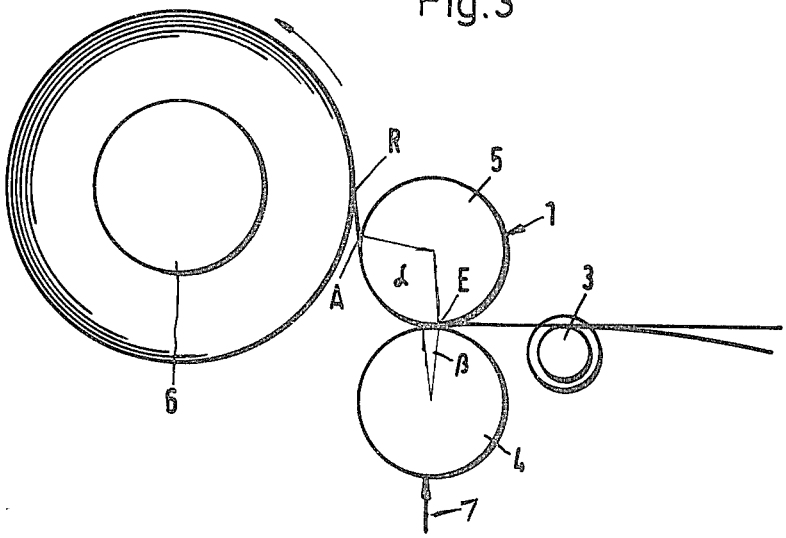
FIG. 3 is a schematic side view of another embodiment of the invention.

Referring now more particularly to FIG. 3, which shows a different positioning for rollers 4 and 5, roller 4 is situated vertically below the roller 5. Roller 4 is pressed against roller 5 by means of a pressing device 7 schematically indicated by the arrow. In addition, the roller 4 is connected to a braking means (not shown) for braking. In the FIG. 3 embodiment, the low angle of wrap of the roller 4 is practically limited to the extent of flattening of the peripheral material of roller 4 on the tapes 2. In this case, hardly any angle of wrap $\beta$ forms. Depending on various factors which includes the surface material, the pressure force and the aimed flattening result, a contact range results, for example, between the rollers 4 and the component strips of tape 2 which corresponds to an angle of wrap $\beta$ of 1° to 4°.

Figure 4:
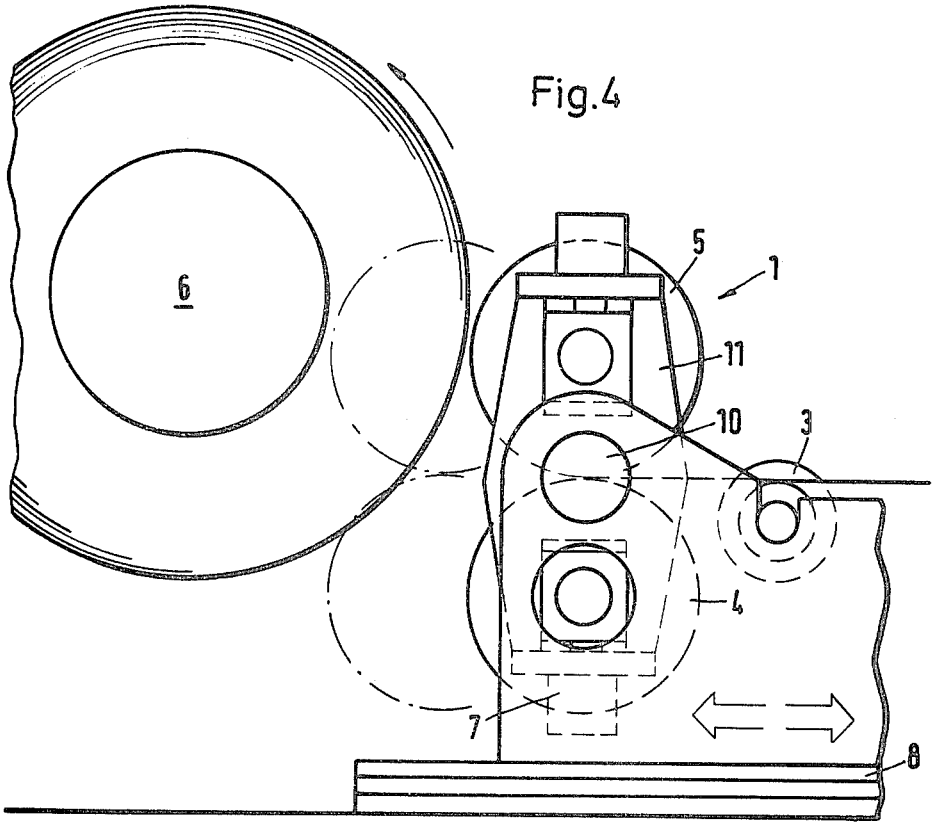
FIG. 4 is a side view of the embodiment of FIG. 3 with rails.

Referring now to FIG. 4, this embodiment corresponds substantially to the embodiment shown in FIG. 3. However, in the FIG. 4 embodiment, the winding device 1 can be run horizontally relative to the recoiler 6. For this purpose, the winding device 1 is arranged on rails 8. The relative movability of the winding device 1 relative to the periphery of the recoiler 6 assures or guarantees that the free path length (i.e. the distance between points R and A as defined in accordance with FIG. 1) of the metal strip between the roller 5 and the metal strip 2 wound on the recoiler 6 can be kept very short, e.g. below 100 mm. As the periphery of the winding coils increases on the recoiler 6, the winding device 1 is continuously moved horizontally to the right.

When winding dry metal strip, a plastic fibrous web with a coefficient of friction $\mu_\alpha$ of 0.28 is provided as peripheral material for the roller 5 with the larger wrap, whereas the roller 4 with the smaller amount of wrap has polyurethane with a coefficient of friction $\mu_\beta$ of 0.5 as the peripheral surface material.

In the FIG. 4 embodiment, the two rollers 4,5 are arranged on a joint rocker 11 which can be swung 180° around an axle having a central middle axis 10 so that the roller 5 can take the position of roller 4 and vice versa. This interchange of positions of rollers 4 and 5 is advantageous when it is necessary to take into account the reversal of the coefficients of friction relative to the surface material of the rollers 4,5 when changing from a dry metal strip to an oiled metal strip.

Figure 5:
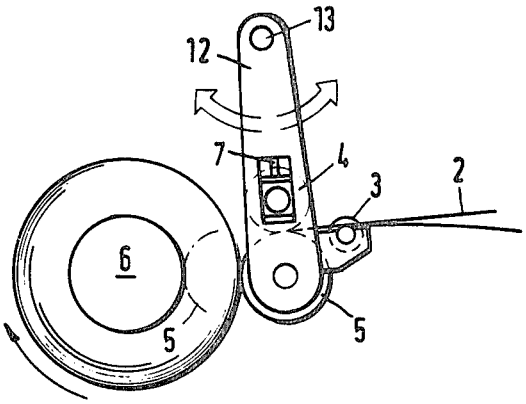
FIG. 5 is a side view of another embodiment of the invention in which both rollers are arranged on a rocker; and, FIG. 6 is a side view of another embodiment of the invention which is a modification of the embodiment of FIG. 5.
Figure 6:
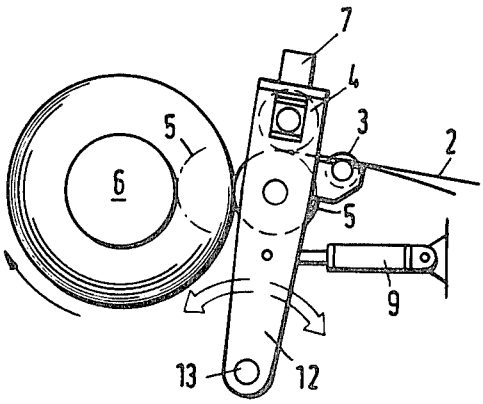

Referring now more particularly to FIGS. 5 and 6 which show simple constructions in which the two rollers 4,5 are arranged in a rocker 12. The rocker arm at one end thereof pivots about an axle having an axis 13. Roller 5 is shown in dotted outline next to recoiler 6 in one position made possible by the pivoting of rocker 12 about axis 13. The rocker 12 is pivotable about the axis 13 to move the rollers 4 and 5 as a unit in the direction of the arrows towards and away from the recoiler 6. Furthermore, as the representation of the roller 5 in dotted lines illustrates, the axis 13 is positioned at such a short distance from the shaft of the recoiler 6 that a short free path length of the tapes 2 after leaving the roller 5 up to the recoiler 6 is guaranteed before winding begins. As the periphery of the tapes 2 increases on the recoiler 6, the rocker 12 can swing away from the recoiler 6 to the right around the axis 13.

Referring now more particularly to the embodiment shown in FIG. 6, a piston-cylinder unit 9 is provided to move the rocker 12 in the direction of the arrows. The rocker 12 with axis 13 is arranged in such a way that the angle of wrap $\beta$ of roller 4 is as small as possible.

In brief, all that remains to be stated concerning the shown and described embodiments is that an angle of wrap of 90° to 150° is particularly preferred for the roller 5 with the larger wrap. Leather, polyurethane and a plastic fibrous web are suitable for surface materials for the rollers 4,5. The choice of material depends upon and is achieved on considering the coefficient of friction, i.e. taking into consideration whether a dry metal strip or an oiled metal strip is to be braked.

The function of the winding device according to the invention is easily understood. The pressed roller 4, which is preferably braked, substantially exerts the braking function on the tapes 2 without there being any danger of a larger amount with the small amount of wrap. During the braking procedure, the tapes are prevented from being pulled along an inclined direction and therefore running laterally because of the large wrap by the roller 5 so that good equalization of the winding length is assured because of slippage. Besides the large wrap, the lower coefficient of friction of this roller 4 also contributes to the good slippage equalization as the slippage equalization can occur without surface damage when the guidance is guaranteed. The winding device 1 therefore guarantees an even braking with good guidance and careful surface treatment, whereby the tapes are well wound on the recoiler 6 particularly when the short free path length between points A and R (see FIGS. 1 and 3) is ensured.

While there has been shown and described what is considered to be the best mode for carrying out the invention and the preferred embodiments of the invention, it will be obvious to those skilled in the art that various changes and modifications may be made therein without departing from the scope of the invention.

We claim:

1. In a winding device for metal strips including a first roller and a second roller, the metal strip being braked between said rollers which are pressed against one another, said first roller having an angle of wrap $\alpha$ for the metal strip of at least 75° and said second roller having a maximum angle of wrap $\beta$ for the metal strip of 45°, the improvement comprising:

said first roller including a material on the periphery thereof having a coefficient of friction $\mu\alpha$ said second roller including a material on the periphery thereof having a coefficient of friction of $\mu\beta$, and the coefficient of friction $\mu\alpha$ being at least 20% lower relative to the braked material strip than the coefficient of friction $\mu\beta$.

2. The winding device according to claim 1, wherein said second roller has an angle of wrap $\beta$ of less than 8°.

3. The winding device of claim 1, wherein the metal strip runs onto said first roller from said second roller at a point of tangency between said first roller and said second roller whereat said rollers are pressed against one another.

4. The winding device according to claim 1, 2 or 3, including a joint rocker having at one end thereof an axle with a central axis, said first roller and said second roller being rotatably connected with said joint rocker, and said joint rocker being pivoted about said axle with the central axis.

5. The winding device according to claim 1, wherein the metal strip is a dry metal strip divided longitudinally into a plurality of tapes, and the coefficient of friction of said first roller $\mu\alpha$ is less than 0.35.

6. The winding device according to claim 1, wherein the metal strip is an oiled metal strip divided longitudinally into a plurality of tapes, and the coefficient of friction of the material on said first roller is less than $\mu\alpha=0.22$.

7. The winding device according to claim 5 or 6, including a recoiler for taking up the metal strip juxtaposed to said rollers, said recoiler having a point at which the metal strip first contacts said recoiler to form a tangent line on said recoiler, and the distance between said tangent line and a pressing line formed between said first roller and said second roller being less than half the periphery of said first roller.

8. The winding device according to claim 1, including braking means for said second roller.

9. The winding device according to claim 1, wherein the coefficient of friction $\mu\alpha$ is at least 50% lower than said coefficient $\mu\beta$.

10. The winding device according to claim 1, wherein the angle of wrap $\alpha$ of said first roller is at least 90°.

11. The winding device according to claim 1, wherein said material on the periphery of said first roller is polyurethane.

12. The winding device according to claim 1, having a recoiler, and the metal strip runs off from said first roller onto said recoiler and forms a free path length between said first roller and said recoiler, said free path length being between 100 and 200 mm.

13. The winding device according to claim 1, having a recoiler, and in which the metal strip runs off from said first roller onto said recoiler and forms a free path length between said first roller and said recoiler, said free path length being less than 100 mm.

14. The winding device according to claim 1, wherein the material for said first roller is a plastic fibrous web and the material for said second roller is polyurethane when the metal strip to be braked is dry.

15. The winding device according to claim 14, wherein the coefficient of friction $\mu\alpha$ is below 0.35.

16. The winding device according to claim 1, wherein the material for said first roller is polyurethane and the material for said second roller is a plastic fibrous web material when the metal strip to be braked is oiled.

17. The winding device according to claim 16, wherein the coefficient of friction $\mu\alpha$ is below 0.22.

18. The winding device according to claim 14 or 16, wherein the angle of wrap of said first roller is between 90° and 150°.

* * * * *